US008128354B2

(12) United States Patent
Hansen et al.

(10) Patent No.: US 8,128,354 B2
(45) Date of Patent: Mar. 6, 2012

(54) GAS TURBINE ENGINE

(75) Inventors: Christian M. Hansen, Simpsonville, SC (US); Friedrich T. Rogers, West Palm Beach, FL (US)

(73) Assignee: Siemens Energy, Inc., Orlando, FL (US)

( * ) Notice: Subject to any disclaimer, the term of this patent is extended or adjusted under 35 U.S.C. 154(b) by 915 days.

(21) Appl. No.: 11/654,353

(22) Filed: Jan. 17, 2007

(65) Prior Publication Data

US 2010/0266399 A1 Oct. 21, 2010

(51) Int. Cl.
*F01D 1/04* (2006.01)

(52) U.S. Cl. ..... 415/191; 415/209.3

(58) Field of Classification Search ..... 415/191, 415/209.2, 209.3, 211.2, 213.1, 214.1
See application file for complete search history.

(56) References Cited

U.S. PATENT DOCUMENTS 2,833,463 A * 5/1958 Morley ..... 415/209.1
2,968,468 A 1/1961 Welsh
4,395,195 A 7/1983 De Cosmo et al.
4,889,470 A * 12/1989 Scalzo ..... 415/209.2
4,897,021 A 1/1990 Chaplin et al.
5,299,910 A 4/1994 Gilchrist
5,423,659 A 6/1995 Thompson
5,709,530 A 1/1998 Cahill et al.
5,846,050 A 12/1998 Schilling
6,851,924 B2 2/2005 Mazzola et al.
6,890,151 B2 * 5/2005 Bertrand et al. ..... 415/209.2

FOREIGN PATENT DOCUMENTS

EP 0353498 A2 7/1990

* cited by examiner

*Primary Examiner* — Edward Look
*Assistant Examiner* — Ryan Ellis

(57) ABSTRACT

A gas turbine engine is provided comprising an outer casing and a plurality of circumferentially positioned vane segments. The outer casing is provided with a circumferential casing slot. The plurality of circumferentially positioned vane segments are coupled to the outer casing. Each vane segment comprises at least one vane airfoil, a radially inner shroud coupled to a first end of the airfoil, a radially outer shroud coupled to a second end of the airfoil, and a strongback fixedly coupled to axially spaced-apart portions of the outer shroud such that a gap is provided between the strongback and the outer shroud. The strongback may comprise axially spaced-apart first and second end portions received in the casing slot.

2 Claims, 10 Drawing Sheets

GAS TURBINE ENGINE

FIELD OF THE INVENTION

The present invention relates to gas turbine engines in general and more specifically to a gas turbine engine having improved vane segments.

BACKGROUND OF THE INVENTION

A gas turbine engine includes a compressor typically comprising a plurality of axial stages which compress airflow in turn. A typical axial compressor includes a split outer casing having two 180 degree halves, which are suitably bolted together. The casing includes rows of axially spaced apart casing slots which extend circumferentially for mounting respective rows of vane segments.

A typical vane segment includes radially outer and inner shrouds between which are attached a plurality of circumferentially spaced apart stator vanes. The outer shroud includes a pair of axially spaced apart forward and aft hooks. The casing includes complementary forward and aft grooves which extend circumferentially within each of the casing slots for receiving the corresponding hooks in a tongue-and-groove mounting arrangement.

During assembly, the individual vane segments are circumferentially inserted into respective ones of the casing halves by engaging the forward and aft hooks with the corresponding forward and aft grooves. Each vane segment is slid circumferentially in turn into the casing slot until all of the vane segments in each casing half are assembled. The two casing halves are then assembled together so that the vane segments in each casing slot define a respective annular row of adjoining vane segments for each compression stage.

In this configuration, the individual vane segments are mounted to the outer casing solely by their outer shrouds, with the vanes and inner shrouds being suspended therefrom.

During operation of the compressor, each vane segment experiences stage differential pressure and airflow impingement, resulting in longitudinal, circumferential, and radial loads being transferred to and through the forward and aft hooks of the vane segment. Those steady loads are combined with pulsating blade-passing aerodynamic excitation loads, which cause the airfoil and outer shroud of the vane segment to vibrate. The vibrations in the outer shroud cause the forward and aft hooks to move within the forward and aft grooves. Such movement results in frictional wear between the outer shroud and the engine casing, which wear reduces part life.

SUMMARY OF THE INVENTION

In accordance with a first aspect of the present invention, a gas turbine engine is provided comprising an outer casing and a plurality of circumferentially positioned vane segments. The outer casing is provided with a circumferential casing slot. The plurality of circumferentially positioned vane segments are coupled to the outer casing. Each vane segment comprises at least one vane airfoil, a radially inner shroud coupled to a first end of the airfoil, a radially outer shroud coupled to a second end of the airfoil, and a strongback fixedly coupled to axially spaced-apart portions of the outer shroud such that a gap is provided between the strongback and the outer shroud. The strongback may comprise axially spaced-apart first and second end portions received in the casing slot.

The gas turbine engine may further comprise a load block provided between two adjacent ones of the vane segments so as to transfer a tangential load from a first one of the vane segments to a second one of the vane segments. A plurality of load blocks may be provided, each provided between a corresponding set of vane segments. At least one torque plate may be coupled between one vane segment to the outer casing so as to transfer a tangential load to the outer casing. Hence, if a plurality of sets of adjacent vanes segments are provided, a torque plate coupled to a vane segment and outer casing may transfer an accumulated tangential load to the outer casing.

The strongback may comprise a main body including end portions defining the axially spaced-apart first and second end portions. The strongback may further include axially spaced-apart first and second members extending radially toward the outer shroud. Preferably, the strongback is fixedly coupled to the outer shroud via the first and second members. Because the strongback is coupled to the outer shroud via the first and second members, the strongback first and second members and main body provide isolation between the axially spaced apart first and second end portions of the strongback and the outer shroud, wherein the outer shroud may be compliant and, hence, displaced during airfoil excitation. This isolation helps mitigate movement or displacement at the first and second end portions of the strongback relative to the outer casing, and thus minimizes wear at the strongback first and second end portions.

The strongback main body may have a thickness of between about 5.0 mm to about 26.95 mm.

The outer shroud may comprise an arcuate main body and axially spaced-apart first and second elements defining the axially spaced-apart portions of the outer shroud. The outer shroud is fixedly coupled to the first and second members of the strongback at the first and second elements.

The outer shroud main body may have a thickness of between about 5.0 mm to about 7.5 mm.

The first and second elements of the outer shroud may be positioned inwardly of outer edges of the first and second end portions of the strongback.

Each vane segment may comprise a plurality of vane airfoils.

The first end portion of the strongback may engage the engine casing along an axially extending interface having a length of between about 40 mm to about 80 mm and the second end portion of the strongback may engage the engine casing along an axially extending interface having a length of between about 12.0 mm to about 18.0 mm.

The first end portion of the strongback may engage the engine casing along a radially extending interface having a length of between about 14.0 mm to about 20.0 mm.

In accordance with a second aspect of the present invention, a vane segment adapted to be received in a circumferential slot of an outer casing of a gas turbine engine is provided. The vane segment comprises at least one vane airfoil; a radially inner shroud coupled to a first end of the airfoil; a radially outer shroud coupled to a second end of the airfoil; and a strongback fixedly coupled to the outer shroud. The strongback may comprise axially spaced-apart first and second end portions adapted to be received in the casing slot.

In accordance with a third aspect of the present invention, a gas turbine engine is provided comprising an outer casing, a plurality of circumferentially positioned vane segments and at least one tangential load block. The outer casing is provided with a circumferential casing slot. The plurality of circumferentially positioned vane segments are coupled to the outer casing. Each vane segment comprises at least one vane airfoil, a radially inner shroud coupled to a first end of the airfoil, a radially outer shroud coupled to a second end of the airfoil, and a strongback fixedly coupled to the outer shroud. The tangential load block may be provided between two adjacent ones of the vane segments so as to transfer a tangential load from a first one of the vane segments to a second one of the vane segments.

The strongback in each of the adjacent ones of the vane segments may be provided with a corresponding recess for receiving the load block. The strongback in the first vane segment may further comprise an opening for receiving a portion of the load block.

DETAILED DESCRIPTION OF THE INVENTION

Figure 1:
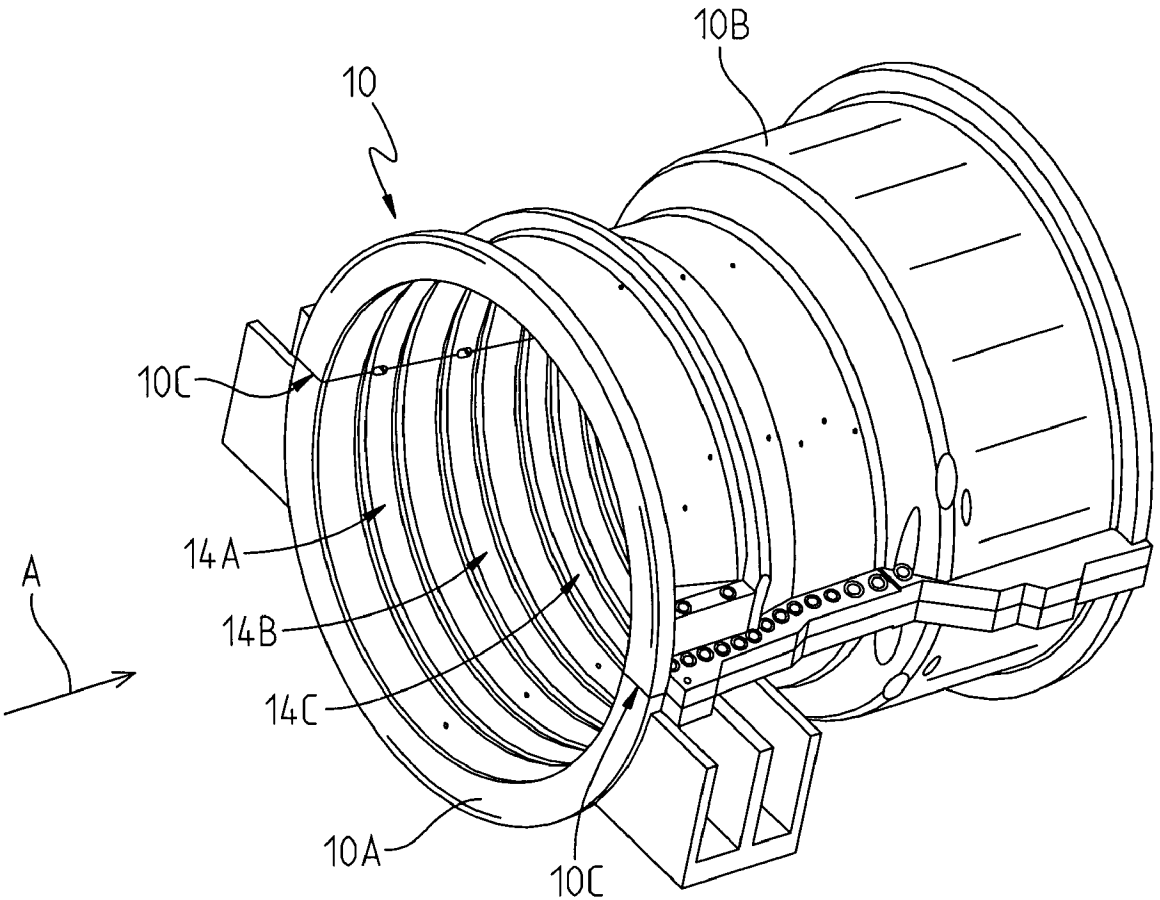
FIG. 1 is a perspective view of the casing of a gas turbine engine formed in accordance with the present invention.
Figure 2:
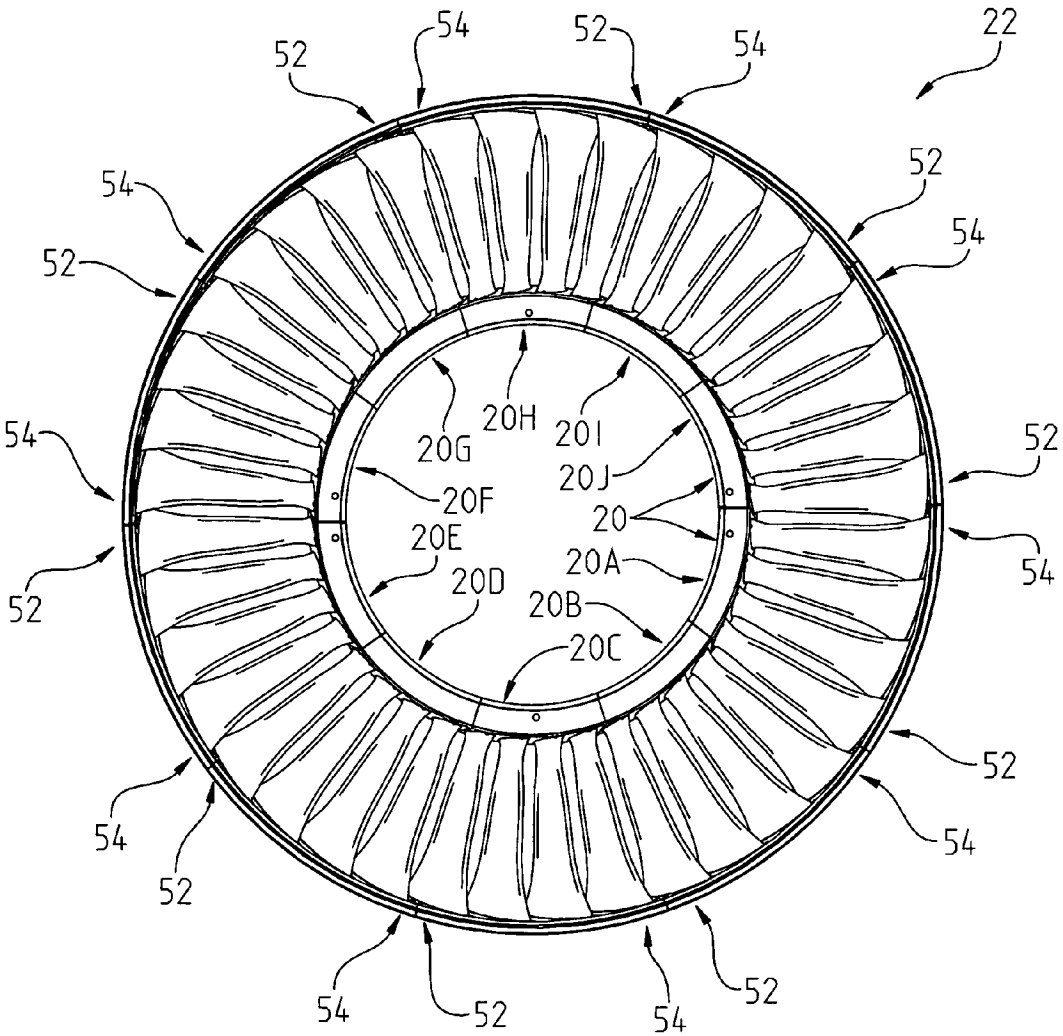
FIG. 2 is a front view of a first row of vane segments of the present invention and shown outside of the casing of FIG. 1.
Figure 2A:
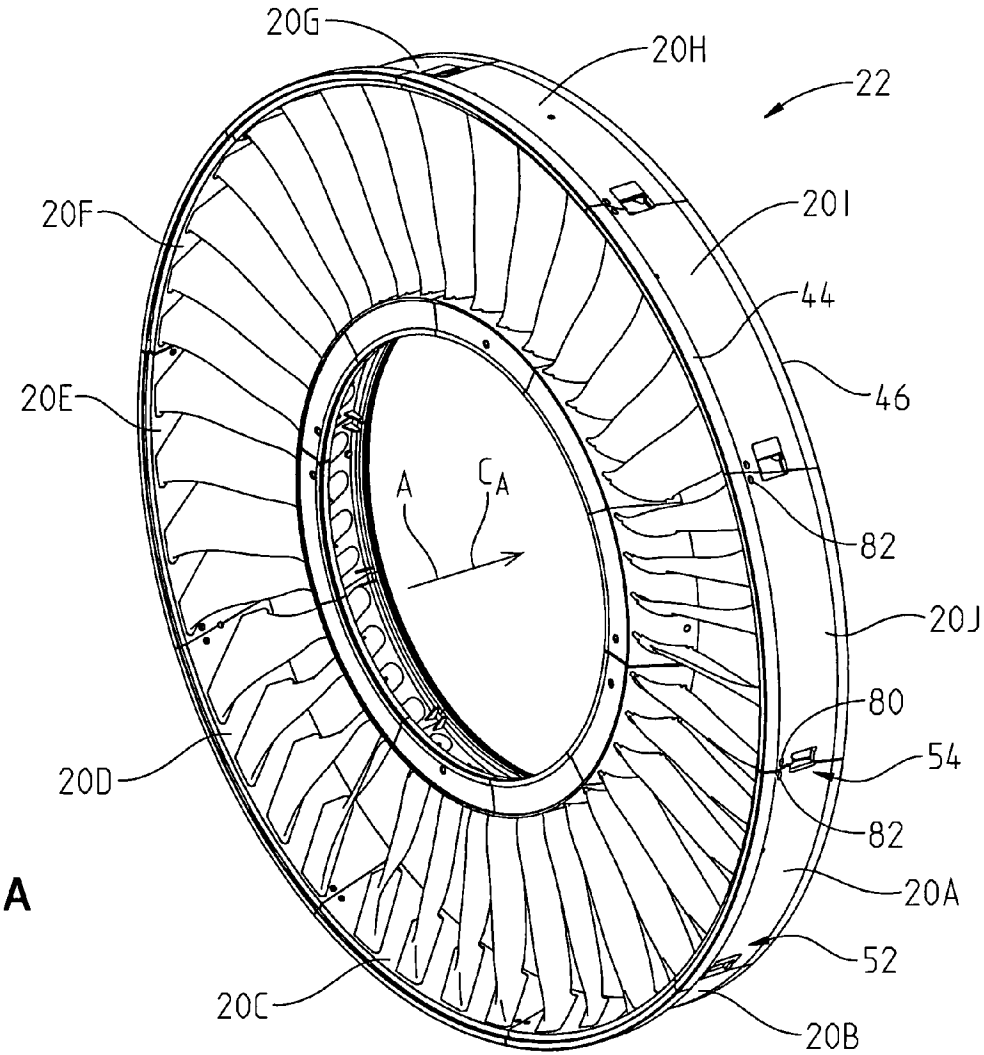
FIG. 2A is a perspective view of the first row of vane segments illustrated in FIG. 2 and without load blocks provided.

FIG. 1 illustrates an annular outer casing 10 of a gas turbine engine. The outer engine casing 10 comprises first and second 180 degree halves 10A and 10B, see also FIG. 14, joined together along axial splitlines 10C via fasteners, such as bolts, not shown. The casing 10 includes a plurality of axially spaced apart casing slots, which extend circumferentially for mounting respective rows of vane segments. However, only the first, second and third casing slots 14A-14C are designated in FIG. 1 for mounting respective first, second and third rows of vane segments 20. The first, second and third rows of vane segments each define a separate aerodynamically unique stator of an axial flow compressor. Only the first row 22 of vane segments 20 is illustrated in FIGS. 2 and 2A. The casing 10 is not illustrated in FIGS. 2 and 2A. Each row of vane segments 20 is disposed coaxially about an axial centerline axis $C_A$ of the axial flow compressor, see FIG. 2A. In the illustrated embodiment, the first row 22 of vane segments 20 comprises first, second, third, fourth and fifth vane segments 20A-20E mounted within the first casing half 10A and sixth, seventh, eighth, ninth and tenth vane segments 20F-20J mounted within the second casing half 10B. Each of the remaining rows of vane segments including the second and third rows of vane segments, not shown, may include ten vane segments as well. Hence, the compressor may comprise multiple rows of vane segments, wherein only the first, second and third rows of vane segments will be described herein. The rows of vane segments are coupled to the outer casing 10.

Figure 3:
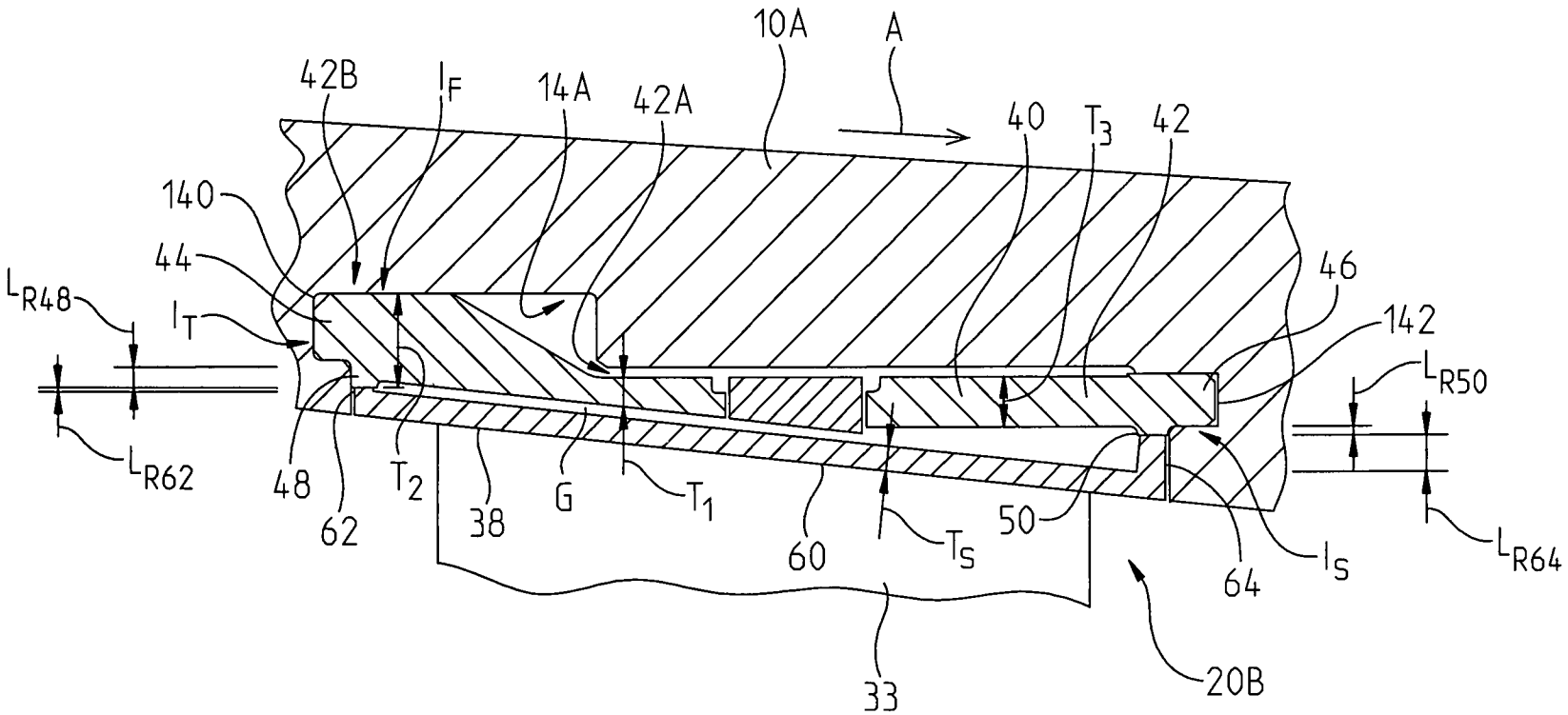
FIG. 3 is a cross sectional view of the casing in FIG. 1 and the second vane segment in FIG. 2.

FIG. 3 illustrates in cross section the circumferential first casing slot 14A in the casing 10A and the second vane segment 20B mounted within the slot 14A. A description follows regarding the geometry of the slot 14A, the construction of the second vane segment 20B and the manner in which the second vane segment 20B is mounted within the slot 14A. This description is also applicable to the construction of the remaining vane segments 20A and 20C-20J mounted within the slot 14A, the construction of the vane segments (not shown) mounted within the remaining slots including the second and third slots 14B and 14C as well as the manner in which those vane segments are mounted within the remaining slots including the second and third slots 14B and 14C.

As shown in FIGS. 1 and 3, the casing slot 14A is configured for mounting the vane segment 20B as well as the remaining vane segments 20A and 20C-20J in a tongue-and-groove manner for allowing ready assembly and disassembly thereof. In the illustrated embodiment, the vane segment 20B comprises first, second, third and fourth airfoils or vanes 30-33, an arcuate radially inner shroud 36 coupled to second ends 30B-33B of the airfoils 30-33, an arcuate radially outer shroud 38 coupled to first ends 30A-33A of the airfoils 30-33, and a strongback 40 fixedly coupled to the outer shroud 38. The airfoils 30-33 are constructed into an integral assembly with the inner and outer shrouds 36 and 38 from a martensitic stainless steel alloy, such as alloy 410. The remaining vane segments 20A and 20C-20J may be constructed in the same manner as the second vane segment 20B.

Figure 5:
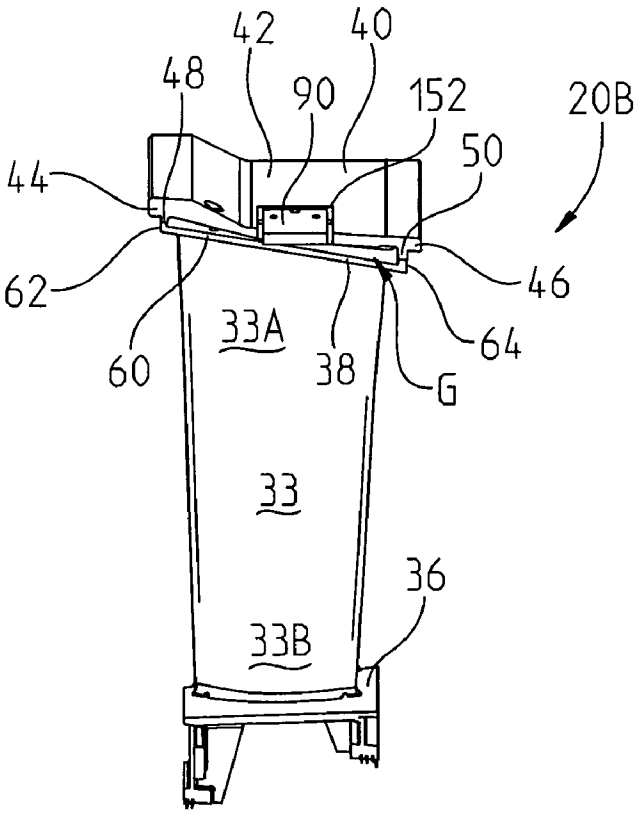
FIG. 5 is an end view of the vane segment illustrated in FIG. 4.

The strongback 40 comprises a main body 42 including axially spaced-apart first and second end portions 44 and 46, see FIGS. 3 and 5. The strongback 40 further comprises axially spaced-apart first and second members 48 and 50 extending radially toward the outer shroud 38. The strongback main body 42 may have a first thickness $T_1$ at a first section 42A of between about 5.0 mm to about 10.0 mm, a second thickness $T_2$ at a second section 42B of between about 17.95 mm to about 26.95 mm and a third thickness $T_3$ of between about 9.25 mm to about 12.75 mm. The first member 48 may have a radial length $L_{R48}$ of between about 4.0 mm to about 7.0 mm, and the second member 50 may have a radial length $L_{R50}$ of between about 3.0 mm to about 12.0 mm, see FIG. 3. The strongback main body 42 may be formed from a martensitic stainless steel alloy, such as alloy 410. As will be discussed below, the strongback 40 is fixedly coupled to the outer shroud 38 via the first and second members 48 and 50.

Figure 4:
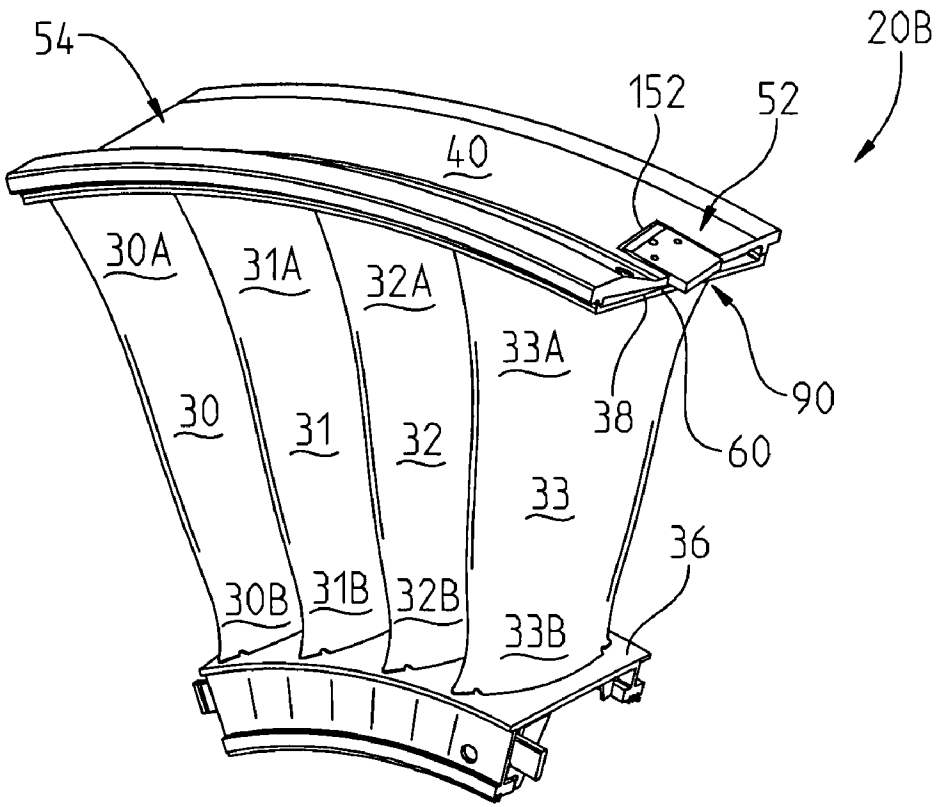
FIG. 4 is a perspective view of the second vane segment of FIG. 2.
Figure 6:
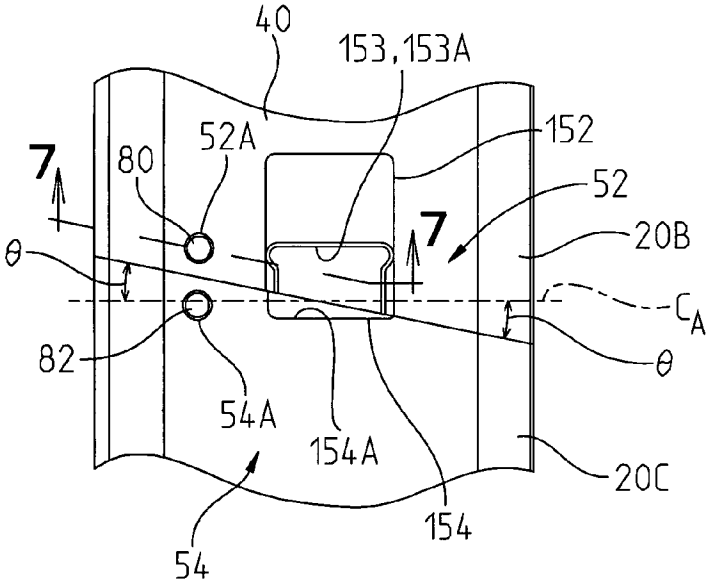
FIG. 6 is a top view of first and second end sections of second and third vane segments illustrated in FIG. 2 without a load block.

The strongback 40 further comprises first and second circumferentially spaced apart first and second end sections 52 and 54, see FIG. 4. As best illustrated in FIG. 6, the first end section 52 of the strongback 40 of the second vane segment 20B extends at an angle θ to the axial centerline axis $C_A$ of the stator, wherein the angle θ may have a value of from about 10 degrees to about 25 degrees. The second end section 54 of the strongback 40 of the second vane segment 20B is not illustrated in FIG. 6. However, the second end section 54 of the strongback 40 of the third vane segment 20C is illustrated in FIG. 6 and extends at an angle θ to the axial centerline axis $C_A$ of the stator, wherein the angle θ may have a value of from about 10 degrees to about 25 degrees. The second end section 54 of the strongback 40 of the second vane segment 20B is configured in the same manner as the second end section 54 of the strongback 40 of the third vane segment 20C and, hence, also extends at an angle θ to the axial centerline axis $C_A$ of the stator, wherein the angle θ may have a value of from about 10 degrees to about 25 degrees. The strongbacks 40 of the remaining vane segments 40A and 40C-40J comprise first and second end sections 52 and 54 configured in the same manner as the first and second end sections 52 and 54 of the strongback 40 of the second vane segment 20B.

The outer shroud 38 comprises an arcuate main body 60 and axially spaced-apart first and second elements 62 and 64, see FIGS. 3 and 5. The outer shroud main body 60 may have a thickness $T_S$ of between about 5.0 mm to about 7.5 mm, see FIG. 3. The outer shroud main body 60 is compliant and may be displaced during operation of the gas turbine engine due to excitation of its corresponding airfoils 30-33. The first and second elements 62 and 64 extend radially toward the strongback 40, see FIGS. 3 and 5. The first element 62 may have a radial length $L_{R62}$ of between about 3.0 mm to about 8.0 mm, and the second element 64 may have a, radial length $L_{R64}$ of between about 5.0 mm to about 10.0 mm, see FIG. 3. As is apparent from FIG. 3, the first and second elements 62 and 64 of the outer shroud 38 are positioned inwardly of the outer edges of the first and second end portions 44 and 46 of the strongback 40.

The outer shroud 38 is fixedly coupled, such as by welding, to the first and second members 48 and 50 of the strongback 40 at the first and second elements 62 and 64. Because of the radial lengths of the first and second members 48 and 50 and the first and second elements 62 and 64, a gap G is defined between the outer shroud 38 and the strongback 40, see FIGS. 3 and 5. The gap G functions to isolate the strongback first and second end portions 44 and 46 from the compliant outer shroud main body 60. The outer shroud main body 60 is compliant so as to accommodate deflections resulting from the aerodynamic excitation of the airfoils 30-33. Thus, the deflections are not imparted to the strongback first and second end portions 44 and 46, which minimizes wear of the strongback first and second end portions 44 and 46 when mounted within the outer casing 10.

Figure 7:
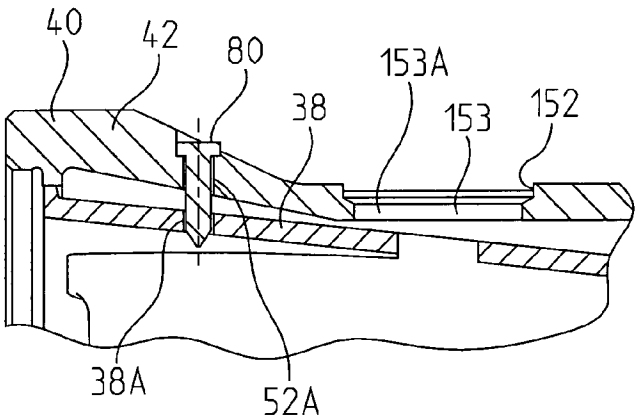
FIG. 7 is a view taken along view line 7-7 in FIG. 6.

In the illustrated embodiment, a first opening 52A is provided in the first end section 52 of the strongback 40 and a second opening 54A is provided in the second end section 54 of the strongback 40, see FIGS. 6 and 7 (as noted above, only the second end section 54 of the strongback 40 of the third vane segment 20C is illustrated in FIG. 6). A first opening 38A, generally in alignment with the first opening 52A, is provided in the outer shroud 38 and a second opening (not shown) generally in alignment with the second opening 54A is provided in the outer shroud 38. A first constraint pin 80 extends through the first opening 52A in the strongback 40 and the first opening 38A in the outer shroud 38. A second constraint pin 82 extends through the second opening 54A in the strongback 40 and the second opening in the outer shroud 38. The first and second constraint pins 80 and 82 are welded to the outer shroud 38 and strongback 40 and function to limit deflection of the outer shroud 38 near the weld between the strongback first member 48 and the outer shroud first element 62 so as to reduce strain at the interface between the first member 48 and the first element 62. Each of the remaining vane segments 20A and 20C-20J is provided with a strongback comprising first and second openings 52A and 52B, an outer shroud 38 comprising first and second openings and first and second constraint pins 80 and 82.

During operation of the compressor, each vane segment 20A-20J experiences axial and tangential loads of a steady nature caused by a difference in pressure across the row of vane segments 20A-20J and the airflow impinging on the corresponding airfoils 30-33. Additionally, there are airfoil-passing aerodynamic excitation loads of a pulsating nature. Together, these loads cause the airfoils 30-33 and, thus, correspondingly, the outer shroud 38 of each vane segment 20A-20J to vibrate. However, because of the configuration of the strongback 40 of each vane segment 20A-20J, i.e., the shape and radial thickness of the strongback 40, as well as the gap G provided between the strongback 40 and the corresponding outer shroud 38, the vibrations in the outer shroud 38 do not travel into and through, the strongback 40. Rather, the vibrations are dissipated as deflections of the outer shroud 38 and as heat at the interfaces between the first and second strongback members 48 and 50 and the first and second outer shroud elements 62 and 64. Hence, the axially spaced-apart first and second end portions 44 and 46 of the strongback 40 of each vane segment 20A-20J move very little relative to the slot 14A in the casing 14. Hence, very little frictional wear occurs between the vane segments 20A-20J and the engine casing 14.

The first slot 14A in the casing 10 is defined in part by an axially extending forward groove 140 and an axially extending aft groove 142, see FIG. 3. Both grooves 140 and 142 extend circumferentially around the casing 10. The first end portion 44 of the strongback main body 42 is adapted to slidingly engage the casing forward groove 140 in a conventional tongue-and-groove arrangement, see FIG. 3. Similarly, the second end portion 46 of the strongback main body 42 is adapted to slidingly engage the casing aft groove 142 in a conventional tongue-and-groove arrangement. The terms forward and aft, as used herein, are relative to the direction of the flow of air traveling through the compressor, as indicated by arrow A in FIGS. 1, 2A and 3. For each of the first, second and third sets of vanes, there is a corresponding set of rotatable blades (not shown). As the air travels in the direction of arrow A, it is compressed in turn by each succeeding set of blades (not shown) within the compressor for elevating its pressure. The first, second and third rows of vane segments comprise stationary flowpath components, or stators as noted above, which direct an airflow through the compressor. Each stator is located immediately downstream of a row of compressor blades and functions to remove swirl from the airflow exiting the upstream row of compressor blades. Multiple rows of vane segments including the first, second and third rows of vane segments direct the airflow toward a downstream row of compressor blades and the last row of vane segments in a multiple-stage axial flow compressor directs the airflow to a combustor (not shown) of the gas turbine engine. The airflow experiences an increase in pressure as it passes through each stator due to the diffusion of the airstream as it passes over the corresponding airfoils as well as a reduction of flowpath area.

During assembly, the first, second, third, fourth and fifth vane segments 20A-20E are circumferentially inserted into the first casing, half 10A by engaging the first and second end portions 44 and 46 of the strongback main body 42 of each vane segment 20A-20E with the forward and aft grooves 140 and 142 of the first slot 14A in the first casing half 10A. Each vane segment segment 20A-20E is slid circumferentially in turn into the casing slot 14A until all of the vane segments 20A-20E in the first casing half 10A are assembled. Likewise, the sixth, seventh, eighth, ninth and tenth vane segments 20F-20J are circumferentially inserted into the second casing half 10B by engaging the first and second end portions 44 and 46 of the strongback main body 42 of each vane segment 20F-20J with the forward and aft grooves 140 and 142 of the second casing half 10B.

After the vane segments 20A-20E have been assembled into the first casing half 10A, the vane segments 20F-20J have been assembled into the second casing half 10B, and the remaining vane segments defining the second and third rows of vane segments have been assembled into the second and third casing slots 14B and 14C, the two casing halves 10A, 10B are coupled together so that the vane segments in each casing slot 14A-14C define a respective annular row of adjoining vane segments 20. In this configuration, the individual vane segments 20 are mounted to the outer casing 10 solely by their outer shrouds 38 and strongbacks 40, with the airfoils 30-33 and inner shrouds 36 being suspended therefrom.

Each vane segment 20 experiences various loads as noted above. Those loads cause the outer shroud 38 of each vane segment 20 to vibrate. However, because of the configuration of the strongback 40 of each vane segment 20, as well as the gap G provided between the strongback 40 and the corresponding outer shroud 38, the vibrations in the outer shroud 38 do not travel into and through the strongback 40. With air moving in the direction of arrow A in FIG. 3, it is noted that the first end portion 44 of the strongback 40 may engage the forward groove 140 along an axially extending first interface $I_F$ having a length of between about 40.0 mm to about 80.0 mm; the second end portion 46 of the strongback 40 may engage the aft groove 142 along an axially extending second interface $I_S$ having a length of between about 12.0 mm to about 18.0 mm; and the first end portion 44 of, the strongback 40 may further engage the forward groove 140 along a radially extending third interface $I_T$ having a length of between about 14.0 mm to about 20.0 mm. Due to the configuration of the strongback 40, the axially spaced-apart first and second end portions 44 and 46 move very little relative to the forward and aft grooves 140 and 142 in which they are positioned. Hence, displacements which can cause frictional wear between each strongback 40 and the engine casing 14 are virtually eliminated, even at the first, second and third interfaces $I_F$, $I_S$ and $I_T$.

In the illustrated embodiment, a recess 152 is provided in the first end section 52 of the strongback 40 of each vane segment 20A-20J, see FIGS. 4-7 and 9. A U-shaped opening or cut-out 153 is also provided in the first end section 52 of the strongback 40 of each vane segment 20A-20J, see FIGS. 6, 7, 9 and 9A. A cut-out 154 is provided in the second end section 54 of the strongback 40 of each vane segment 20A-20J, see FIGS. 6 and 9.

Figure 9A:
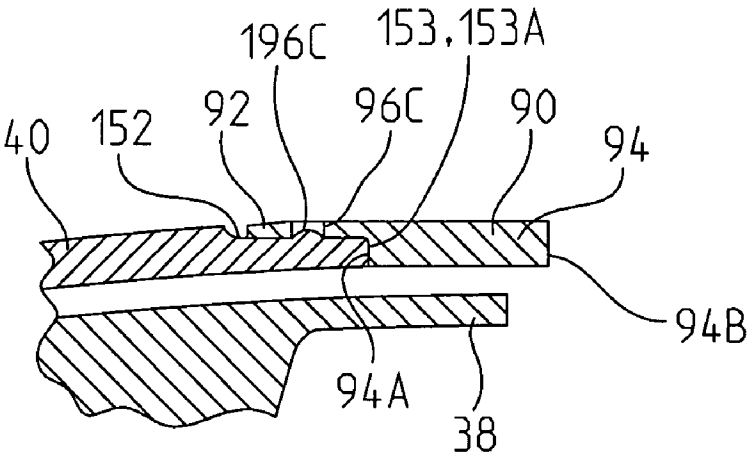
FIG. 9A is a cross sectional view of the second end section of the second vane segment and a load block coupled to the second vane segment.
Figure 9:
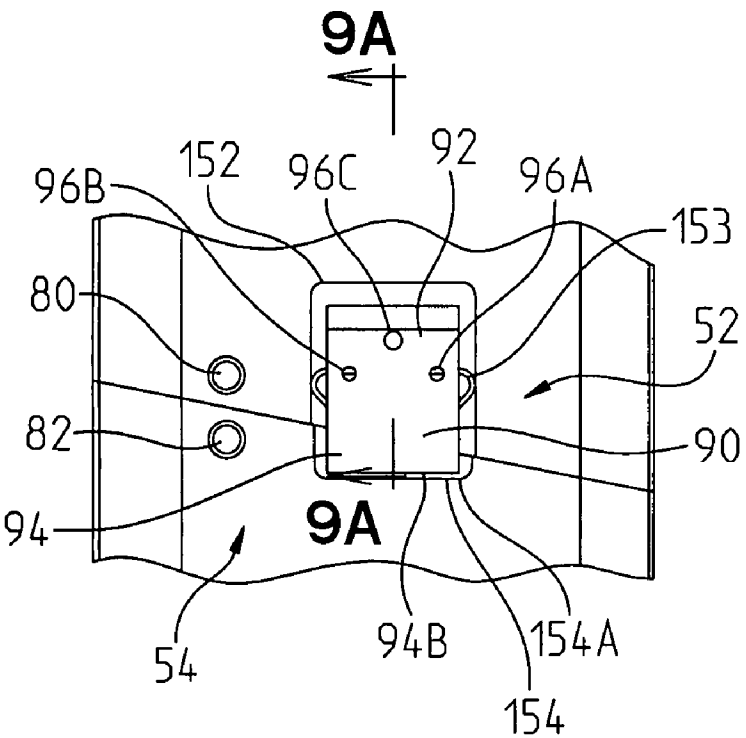
FIG. 9 is a top view of first and second end sections of second and third vane segments illustrated in FIG. 2 with a load block extending between the second and third vane segments.

A tangential load block 90 may be provided at an interface between a first end section 52 of a strongback 40 forming part of one vane segment 20 and a second end section 54 of a strongback 40 forming part of an adjacent vane segment 20, see FIG. 9. In the illustrated embodiment, a load block 90 is provided at an interface between vane segment pairs 20A/20B; 20B/20C; 20C/20D; 20D/20E; 20F/20G; 20G/20H; 20H/20I; and 20I/20J, see FIGS. 2 and 9.

Figure 8:
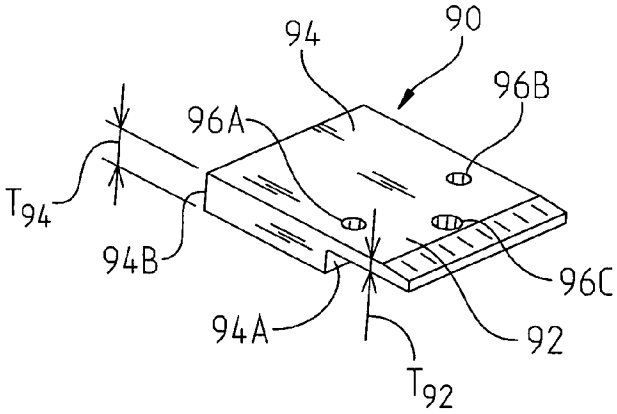
FIG. 8 is a perspective view of a load block.

Each tangential load block 90 comprises a front section 92 having a maximum thickness $T_{92}$, and a rear section 94 having a thickness $T_{94}$, which is greater than the thickness $T_{92}$ of the front section 92, see FIG. 8. The load block 90 further comprises first and second sight holes 96A and 96B and a weld hole 96C. The front section 92 of the load block 90 is received in the recess 152 provided in the first end section 52 of a strongback 40 of one vane-segment 20, see FIGS. 9 and 9A. A portion of the rear section 94 of the load block 90 is received' in the U-shaped cut-out 153 of the strongback 40 such that a front wall 94A of the rear section 94 abuts against a wall 153A defining a portion of the U-shaped cut-out 153, see FIG. 9A. During assembly, the load block 90 may be aligned relative to the wall 153A by locating the wall 153A in the sight holes 96A and 96B. Once aligned, the load block 90 is welded to the strongback 40 by creating a weld 196C through the hole 96C of the load block 90, see FIG. 9A. A remaining portion of the rear section 94 of the load block 90 is received in the cut-out 154 formed in the second end section 54 of a strongback 40 of an adjacent vane segment 20, see FIG. 9. A rear wall 94B of the rear section 94 of the load block 90 is adapted to engage a wall 154A defining a portion of the cut-out 154 in the second end section 54 of the strongback 40 of the adjacent vane segment, see FIG. 9.

During operation of the compressor, with the flow of air moving in the direction of arrow A in FIG. 2A, compressed air located upstream from the first row 22 of vane segments 20A-20J applies forces to the vane segments 20A-20J such that the vane segments 20A-20J want to rotate clockwise in FIG. 2A. Tangential forces from the first vane segment, e.g., vane segment 20A, of each of vane segments pairs 20A/20B; 20B/20C; 20C/20D; 20D/20E; 20F/20G; 20G/20H; 20H/20I; and 20I/20J are transferred to the adjacent second vane segment, e.g., vane segment 20B, of each of these pairs via the corresponding load block 90.

Figure 10:
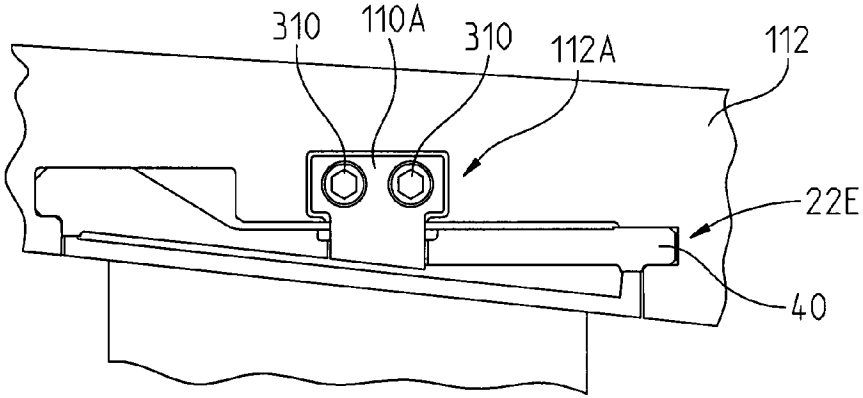
FIG. 10 is a top view of a first torque plate bolted to the first casing half and engaging the fifth vane segment.
Figure 12:
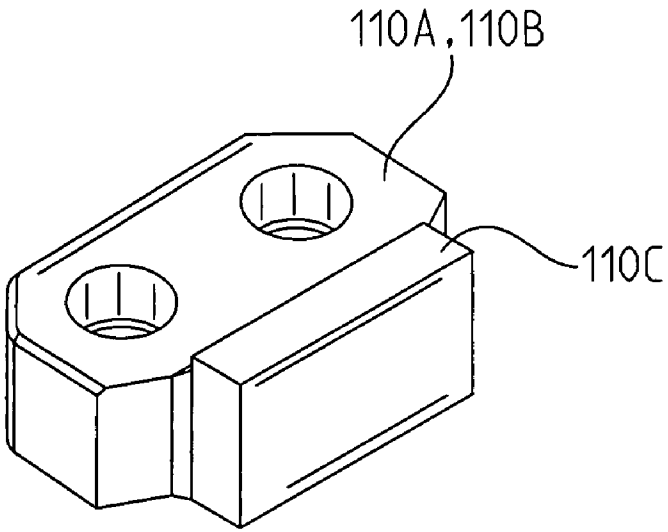
FIG. 12 is a perspective view of a torque plate.

A load block 90 is not provided at the interfaces of vane segments 20J/20A and 20E/20F. The first and second halves 10A and 10B of the engine casing 10 are shown separated in FIG. 14. For the first row 22 of vane segments, a first torque plate 110A, see FIG. 12, is bolted via bolts 310 to a first edge 112 of the first half 10A of the engine casing 10 at a first edge section 112A near the first slot 14A, see FIGS. 10 and 14, and a second torque plate 110B, see FIG. 12, is bolted to a first edge 114 of the second half 10B of the engine casing 10 at a first edge section 114A near the first slot 14A, see FIG. 14. Once the vane segments 20A-20E have, been assembled in the first half 10A of the engine casing 10, a bearing face 110C on the first torque plate 110A engages with the wall 153A defining a portion of the U-shaped cut-out 153 provided in the first end section 52 of the strongback 40 of the fifth vane segment 20E. The first torque plate 110A functions to transfer tangential load from the strongback 40 of the fifth vane segment 20E to the outer casing 10. The tangential load transferred from the fifth vane segment 20E to the outer casing 10 includes a summation of tangential loads transferred between each of vane segment pairs 20A/20B; 20B/20C; 20C/20D; and 20D/20E. Likewise, once the vane segments 20F-20J have been assembled in the second half 10B of the engine casing 10, a bearing face 110C on the second torque plate 110B engages with the wall 153A defining a portion of the U-shaped cut-out 153 provided in the first end section 52 of the strongback 40 of the tenth vane segment 20J. The second torque plate 110B functions to transfer tangential load from the strongback 40 of the tenth vane segment 20J to the outer casing 10. The tangential load transferred from the tenth vane segment 20J to the outer casing 10 includes a summation of tangential loads transferred between each of vane segment pairs 20F/20G; 20G/20H; 20H/20I; and 20I/20J.

Figure 11:
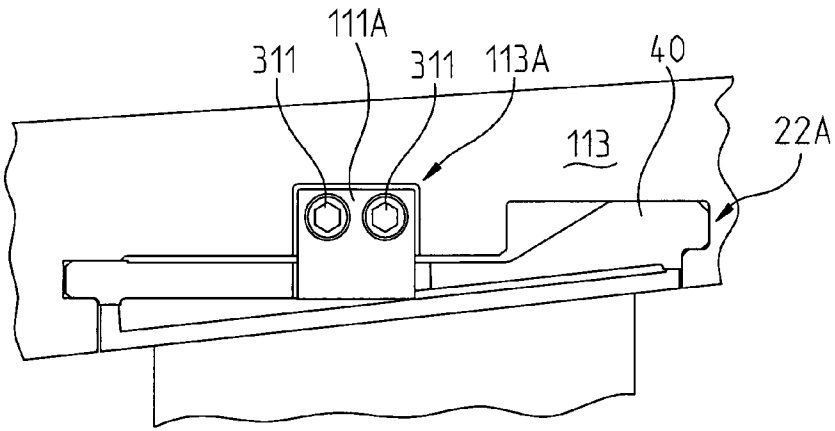
FIG. 11 is a top view of a first retention plate bolted to the first casing half and engaging the first vane segment.
Figure 13:
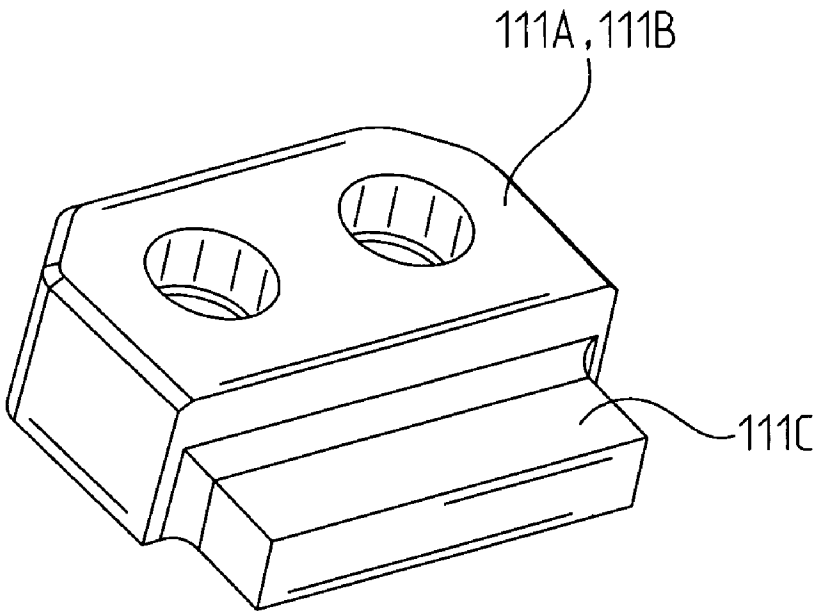
FIG. 13 is a perspective view of a retention plate.
Figure 14:
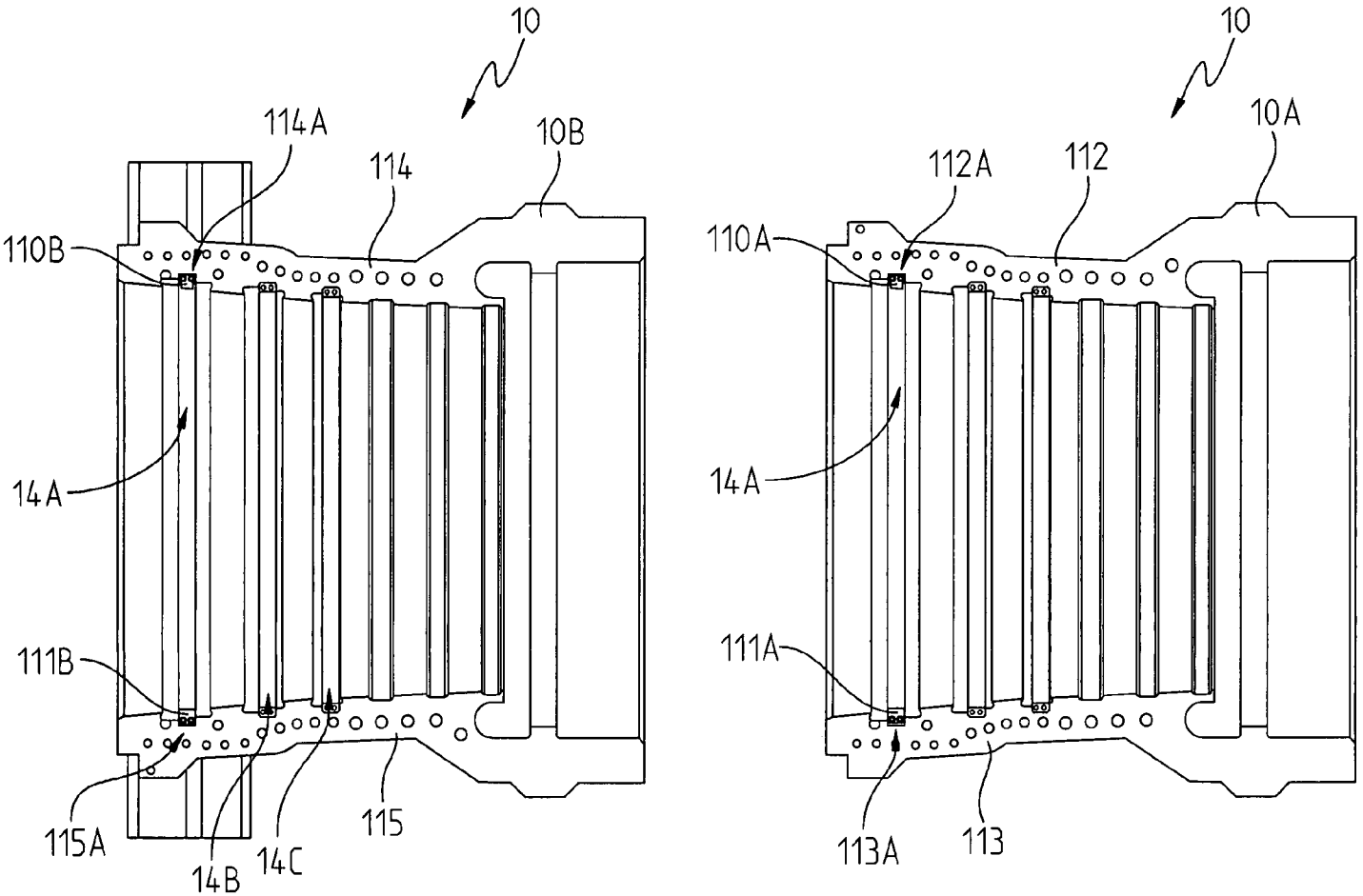
FIG. 14 is a radially-outboard view of first and second separated halves of the casing illustrated in FIG. 1.

Once the first, second, third, fourth and fifth vane segments 20A-20E have been inserted into the first half 10A of the engine casing 10, a first retention plate 111A, see FIG. 11, is bolted to a second edge 113 of the first half 10A of the engine casing 10 at a first edge section 113A near the first slot 14A, see FIGS. 11 and 14, to assist in maintaining the vane segments 20A-20E in the first casing half 10A. A bearing face 111C on the first retention plate 111A engages with the wall 154A defining a portion of the cut-out 154 in the second end section 54 of the strongback 40 of the first vane segment 20A. Once the sixth, seventh, eighth, ninth, and tenth vane segments 20F-20J have been inserted into the second half 10B of the engine casing 10, a second retention plate 111B, see FIG. 11, is bolted to a second edge 115 of the second half 10B of the engine casing 10A at a first edge section 115A near the first slot 14A, see FIG. 14, to assist in maintaining the vane segments 20F-20J in the second casing half 10B. A bearing face 111C on the second retention plate 111B engages with the wall 154A defining a portion of the cut-out 154 in the second end section 54 of the strongback 40 of the sixth vane segment 20F. With air moving through the casing 10 in the direction of arrow A in FIG. 1, little or no torque is applied to the first and second retention plates 111A and 111B by the vane segments 20A and 20F.

While not illustrated, first and second torque plates 110A and 110B and first and second retention plates 111A and 111B may be coupled to the first and second casing halves 10A and 10B for the remaining rows of vane segments including the second and third rows of vane segments.

While a particular embodiment of the present invention has been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A gas turbine engine comprising:

an outer casing with a circumferential casing slot;

a plurality of circumferentially positioned vane segments coupled to said outer casing, each vane segment comprising at least one vane airfoil, a radially inner shroud coupled to a first end of said airfoil, a radially outer shroud coupled to a second end of said airfoil, and a strongback fixedly coupled to said outer shroud; and at least one tangential load block provided between two adjacent ones of said vane segments so as to transfer a tangential load from a first one of said vane segments to a second one of said vane segments;

wherein said strongback in each of said adjacent ones of said vane segments is provided with a corresponding recess for receiving said load block.

2. A gas turbine engine as set forth in claim 1, wherein said strongback in said first vane segment further comprises an opening for receiving a portion of said load block.

* * * * *